US011250669B1

(12) United States Patent
Huke et al.

(10) Patent No.: US 11,250,669 B1
(45) Date of Patent: Feb. 15, 2022

(54) COMMUNITY BASED EVENT DRIVEN WAGERING PLATFORM

(71) Applicant: AdrenalineIP, Washington, DC (US)

(72) Inventors: Casey Alexander Huke, Washington, DC (US); John Cronin, Jericho, VT (US); Michael D'Andrea, Burlington, VT (US); Joseph Bodkin, Quincy, MA (US)

(73) Assignee: AdrenalineIP, Washington, DC (US)

( * ) Notice: Subject to any disclaimer, the term of this patent is extended or adjusted under 35 U.S.C. 154(b) by 0 days.

(21) Appl. No.: 16/950,269

(22) Filed: Nov. 17, 2020

Related U.S. Application Data

(60) Provisional application No. 63/054,402, filed on Jul. 21, 2020.

(51) Int. Cl.
*G07F 17/32* (2006.01)
*G06Q 50/34* (2012.01)

(52) U.S. Cl.
CPC ..... *G07F 17/3272* (2013.01); *G06Q 50/34* (2013.01); *G07F 17/323* (2013.01); *G07F 17/3237* (2013.01); *G07F 17/3288* (2013.01)

(58) Field of Classification Search
CPC ..... G06F 17/3272; G06F 17/3237; G06F 17/323; G06F 17/3288; G06F 17/3279; G06Q 50/34; G07F 17/3272; G07F 17/3237; G07F 17/323; G07F 17/3288; G07F 17/3279
See application file for complete search history.

(56) References Cited

U.S. PATENT DOCUMENTS

2003/0054905 A1* 3/2003 King, Jr. ..... A63B 24/0021 473/467
2007/0054739 A1* 3/2007 Amaitis ..... G07F 17/3276 463/42
2007/0167210 A1* 7/2007 Kelly ..... G07F 17/32 463/16
2014/0228098 A1* 8/2014 Englman ..... G07F 17/3272 463/25
2017/0103615 A1* 4/2017 Theodosopoulos ..... G07F 17/3276
2020/0126365 A1* 4/2020 Eckman ..... G07F 17/3225

OTHER PUBLICATIONS

Notification of Transmittal of the International Search Report and the Written Opinion of the International Searching Authority dated Aug. 6, 2021, in connection with corresponding international Application No. PCT/US2021/041031 (10pp.).

* cited by examiner

*Primary Examiner* — Jasson H Yoo
(74) *Attorney, Agent, or Firm* — Maier & Maier, PLLC

(57) ABSTRACT

A system for wagering on individual events in a sporting event. In addition to allowing users to wager on individual events, the system allows the creation of communities of users based upon a number of different factors, including location, team affiliation, betting history, or other common factors. Users can view their standing among their own communities and specialty communities, such as celebrities or experts, on a leaderboard. Wagers can be based upon the user's standing on a leaderboard at the end of a predetermined number of game events. The system further allows users to message other members and propose wagers directly to other players.

12 Claims, 6 Drawing Sheets

| | | | Communities the user is a member of | | | Peer to Peer Wagers | | |
|---|---|---|---|---|---|---|---|---|
| User ID | GPS Location | Wagering History | Community 1 | … | Community n | Peer to Peer Wager 1 | … | Peer to Peer Wager n |
| 1 | location.dat | wagers.dat | Giants Fans | | New York Metro Area | Giants complete third and 10 – user 7 | | Standing in Giants Fans Community |
| 2 | location.dat | wagers.dat | Ravens Fans | | MetLife Stadium | Ravens convert third and 1 – user 25 | | Standing in MetLife Stadium Community |
| … | | | | | | | | |
| n | location.dat | wagers.dat | University of Alabama Alumni | | Birmingham Residents | NA | | NA |

| Peer to Peer Messages | | | Community Invite(s) | | | Specialty Communities | | |
|---|---|---|---|---|---|---|---|---|
| Peer to Peer Message 1 | … | Peer to Peer Message n | Community 1 | … | Community n | Specialty Community 1 | … | Specialty Community n |
| "you stink" – user 7 | | NA | NYU Alumni | | NA | NA | | NA |
| "I'll get you next time" – user 25 | | NA | Amazon Employees | | NA | Insurance Salespeople | | NA |
| | | | | | | | | |
| NA | | NA | NA | | NA | College Football Alumni | | Professional Football Players |

Fig. 2

COMMUNITY BASED EVENT DRIVEN WAGERING PLATFORM

FIELD

The embodiments are generally related to wagering on individual events inside of a sporting event. The use of mobile devices to facilitate event based wagering, and how the multitude of users of mobile event driven wagering platform interact with one another.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

While sports gambling is popular, it is often rather impersonal and isolating for users, as the gambling software is typically between the user and a computer system that is offering the wagers.

The sports wagering market today provides for numerous new opportunities with wagering with individuals in regards to specific events inside of a real time sporting event. The fast paced nature of this new type of in-play wagering is uniquely suited to a more social style of wagering than offered by traditional sports books and or online wagering platforms.

SUMMARY

A community-based gaming method may be provided. The method may include calculating odds of events within a live sporting event, communicating the odds as available wagers to a user, receiving selected wagers, monitoring event results, and calculating the user's balance based on the event results and the selected wagers. The method may continue by providing for peer to peer wagering between users, allowing users to view their relative standing amongst various communities, and providing wagers based on a user's standing within a community.

An exemplary embodiment may provide a community building module, where users may create, join, or invite others to a number of communities. Communities may be based on geographical location, broadcast area, user winnings, user rankings, or any other contemplated criteria.

A further embodiment includes the use of a proprietary data management and analytic statistical software system/wagering platforms through which users place wagers on games and are accordingly ranked on a leaderboard and are rewarded based upon the user's respective place on the leaderboard. For example, a leaderboard could display the top one hundred users, but could easily expand to the top one thousand. The present invention includes a proprietary payout structure for users ranked on leaderboards using a data management and analytical software system/wagering platform. Through this data management and analytics software system, users place wagers on games and are ranked on a leaderboard and are reward based upon his or her respective place on the leaderboard. Currently, the leaderboard displays the top one hundred users (but could easily expand to the top one thousand), and users are grouped according to individual rankings (e.g., fourth place through twenty-fifth place, twenty-sixth place through one-hundredth place) and rewarded accordingly (e.g., ten cents to those in twenty-sixth place, twenty-five cents to those in twenty-fifth to fourth place, two dollars to third place, ten dollars to second place, and twenty dollars to first place).

Another embodiment includes a community-based leaderboard, where users of the data management and analytic statistical software/real money wagering system are ranked on leaderboards specific to certain bets/games and, through the use of geolocation, are notified of fellow leaderboard members in attendance at games. For example, a user can scan his or her game ticket into the data management and analytics software system and then receive notifications as to the locations of fellow leaderboard members also in attendance (e.g., number forty is two rows behind you). Furthermore, users can identify fellow leaderboard members at a local sports bar, for example, and create a sub-leaderboard consisting only of those members in attendance. The present invention includes the use of a modification of the current sports wagering system application invention in which it is set up as a peer-to-peer wagering system, where one mobile device acts as the server does in the current invention. For example, this invention can be used in the event that Joe and Mike are watching the game and betting against one other on each play over the course of a game, where the winner will be the one who made the most correct bets during the course of the game. The present invention includes a proprietary method of indicating the winners of peer-to-peer wagers (made through a sports betting application) to those within that peer-to-peer wager by displaying an avatar or image of the winning user within that group on the mobile devices or displays used by those group members.

BRIEF DESCRIPTIONS OF THE DRAWINGS

The accompanying drawings illustrate various embodiments of systems, methods, and embodiments of various other aspects of the disclosure. Any person with ordinary skills in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

FIG. 2 illustrates a user database, according to an embodiment.

DETAILED DESCRIPTION

Figure 1:
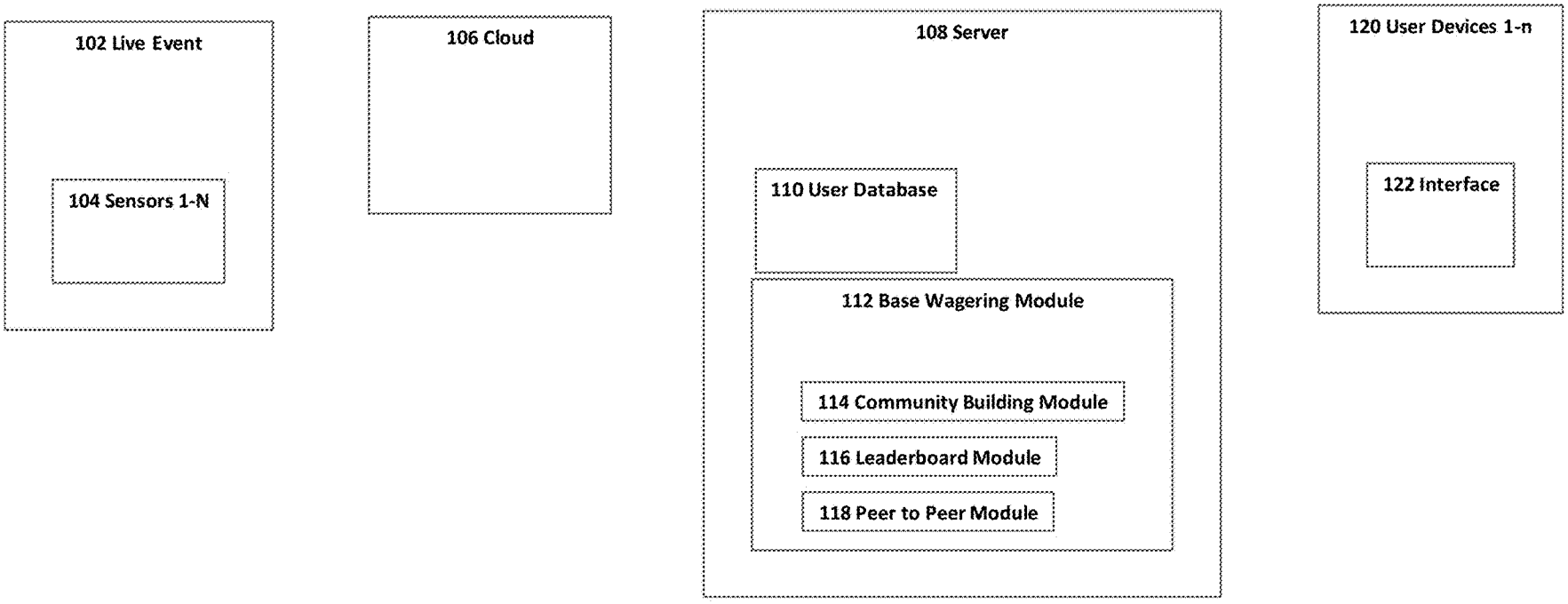
FIG. 1 illustrates a community-based event driven wagering platform, according to an embodiment.

Aspects of the present invention are disclosed in the following description and related figures directed to specific embodiments of the invention. Those of ordinary skill in the art will recognize that alternate embodiments may be devised without departing from the spirit or the scope of the claims. Additionally, well-known elements of exemplary embodiments of the invention will not be described in detail or will be omitted so as not to obscure the relevant details of the invention As used herein, the word exemplary means serving as an example, instance or illustration. The embodiments described herein are not limiting, but rather are exemplary only. It should be understood that the described embodiments are not necessarily to be construed as preferred or advantageous over other embodiments. Moreover, the terms embodiments of the invention, embodiments or invention do not require that all embodiments of the invention include the discussed feature, advantage, or mode of operation.

Further, many of the embodiments described herein are described in terms of sequences of actions to be performed by, for example, elements of a computing device. It should be recognized by those skilled in the art that the various sequence of actions described herein can be performed by specific circuits (e.g., application specific integrated circuits (ASICs)) and/or by program instructions executed by at least one processor. Additionally, the sequence of actions described herein can be embodied entirely within any form of computer-readable storage medium such that execution of the sequence of actions enables the processor to perform the functionality described herein. Thus, the various aspects of the present invention may be embodied in a number of different forms, all of which have been contemplated to be within the scope of the claimed subject matter. In addition, for each of the embodiments described herein, the corresponding form of any such embodiments may be described herein as, for example, a computer configured to perform the described action.

With respect to the embodiments, a summary of terminology used herein is provided.

An action refers to a specific play or specific movement in a sporting event. For example, an action may determine which players were involved during a sporting event. In some embodiments, an action may be a throw, shot, pass, swing, kick, hit, performed by a participant in a sporting event. In some embodiments, an action may be a strategic decision made by a participant in the sporting event such as a player, coach, management, etc. In some embodiments, an action may be a penalty, foul, or type of infraction occurring in a sporting event. In some embodiments, an action may include the participants of the sporting event. In some embodiments, an action may include beginning events of sporting event, for example opening tips, coin flips, opening pitch, national anthem singers, etc. In some embodiments, a sporting event may be football, hockey, basketball, baseball, golf, tennis, soccer, cricket, rugby, MMA, boxing, swimming, skiing, snowboarding, horse racing, car racing, boat racing, cycling, wrestling, Olympic sport, eSports, etc. Actions can be integrated into the embodiments in a variety of manners.

A "bet" or "wager" is to risk something, usually a sum of money, against someone else's or an entity on the basis of the outcome of a future event, such as the results of a game or event. It may be understood that non-monetary items may be the subject of a "bet" or "wager" as well, such as points or anything else that can be quantified for a "wager" or "bet." A bettor refers to a person who bets or wagers. A bettor may also be referred to as a user, client, or participant throughout the present invention. A "bet" or "wager" could be made for obtaining or risking a coupon or some enhancements to the sporting event, such as better seats, VIP treatment, etc. A "bet" or "wager" can be done for certain amount or for a future time. A "bet" or "wager" can be done for being able to answer a question correctly. A "bet" or "wager" can be done within a certain period of time. A "bet" or "wager" can be integrated into the embodiments in a variety of manners.

A "book" or "sportsbook" refers to a physical establishment that accepts bets on the outcome of sporting events. A "book" or "sportsbook" system enables a human working with a computer to interact, according to set of both implicit and explicit rules, in an electronically powered domain for the purpose of placing bets on the outcome of sporting event. An added game refers to an event not part of the typical menu of wagering offerings, often posted as an accommodation to patrons. A "book" or "sportsbook" can be integrated into the embodiments in a variety of manners.

To "buy points" means a player pays an additional price (more money) to receive a half-point or more in the player's favor on a point spread game. Buying points means you can move a point spread, for example up to two points in your favor. "Buy points" can be integrated into the embodiments in a variety of manners.

The "price" refers to the odds or point spread of an event. To "take the price" means betting the underdog and receiving its advantage in the point spread. "Price" can be integrated into the embodiments in a variety of manners.

"No action" means a wager in which no money is lost or won, and the original bet amount is refunded. "No action" can be integrated into the embodiments in a variety of manners.

The "sides" are the two teams or individuals participating in an event: the underdog and the favorite. The term "favorite" refers to the team considered most likely to win an event or game. The "chalk" refers to a favorite, usually a heavy favorite. Bettors who like to bet big favorites are referred to "chalk eaters" (often a derogatory term). An event or game in which the sports book has reduced its betting limits, usually because of weather or the uncertain status of injured players is referred to as a "circled game." "Laying the points or price" means betting the favorite by giving up points. The term "dog" or "underdog" refers to the team perceived to be most likely to lose an event or game. A "longshot" also refers to a team perceived to be unlikely to win an event or game. "Sides", "favorite", "chalk", "circled game", "laying the points price", "dog" and "underdog" can be integrated into the embodiments in a variety of manners.

The "money line" refers to the odds expressed in terms of money. With money odds, whenever there is a minus (−) the player "lays" or is "laying" that amount to win (for example $100); where there is a plus (+) the player wins that amount for every $100 wagered. A "straight bet" refers to an individual wager on a game or event that will be determined by a point spread or money line. The term "straight-up" means winning the game without any regard to the "point spread"; a "money-line" bet. "Money line", "straight bet", "straight-up" can be integrated into the embodiments in a variety of manners.

The "line" refers to the current odds or point spread on a particular event or game. The "point spread" refers to the margin of points in which the favored team must win an event by to "cover the spread." To "cover" means winning by more than the "point spread". A handicap of the "point spread" value is given to the favorite team so bettors can choose sides at equal odds. "Cover the spread" means that a favorite win an event with the handicap considered or the underdog wins with additional points. To "push" refers to when the event or game ends with no winner or loser for wagering purposes, a tie for wagering purposes. A "tie" is a wager in which no money is lost or won because the teams' scores were equal to the number of points in the given "point spread". The "opening line" means the earliest line posted for a particular sporting event or game. The term "pick" or "pick 'em" refers to a game when neither team is favored in an event or game. "Line", "cover the spread", "cover", "tie", "pick" and "pick-em" can be integrated into the embodiments in a variety of manners.

To "middle" means to win both sides of a game; wagering on the "underdog" at one point spread and the favorite at a different point spread and winning both sides. For example, if the player bets the underdog +4½ and the favorite −3½ and the favorite wins by 4, the player has middled the book and won both bets. "Middle" can be integrated into the embodiments in a variety of manners.

Digital gaming refers to any type of electronic environment that can be controlled or manipulated by a human user for entertainment purposes. A system that enables a human and a computer to interact according to set of both implicit and explicit rules, in an electronically powered domain for the purpose of recreation or instruction. "eSports" refers to a form of sports competition using video games, or a multiplayer video game played competitively for spectators, typically by professional gamers. Digital gaming and "eSports" can be integrated into the embodiments in a variety of manners.

The term event refers to a form of play, sport, contest, or game, especially one played according to rules and decided by skill, strength, or luck. In some embodiments, an event may be football, hockey, basketball, baseball, golf, tennis, soccer, cricket, rugby, MMA, boxing, swimming, skiing, snowboarding, horse racing, car racing, boat racing, cycling, wrestling, Olympic sport, etc. Event can be integrated into the embodiments in a variety of manners.

The "total" is the combined number of runs, points or goals scored by both teams during the game, including overtime. The "over" refers to a sports bet in which the player wagers that the combined point total of two teams will be more than a specified total. The "under" refers to bets that the total points scored by two teams will be less than a certain figure. "Total", "over", and "under" can be integrated into the embodiments in a variety of manners.

A "parlay" is a single bet that links together two or more wagers; to win the bet, the player must win all the wagers in the "parlay". If the player loses one wager, the player loses the entire bet. However, if he wins all the wagers in the "parlay", the player wins a higher payoff than if the player had placed the bets separately. A "round robin" is a series of parlays. A "teaser" is a type of parlay in which the point spread, or total of each individual play is adjusted. The price of moving the point spread (teasing) is lower payoff odds on winning wagers. "Parlay", "round robin", "teaser" can be integrated into the embodiments in a variety of manners.

A "prop bet" or "proposition bet" means a bet that focuses on the outcome of events within a given game. Props are often offered on marquee games of great interest. These include Sunday and Monday night pro football games, various high-profile college football games, major college bowl games and playoff and championship games. An example of a prop bet is "Which team will score the first touchdown?" "Prop bet" or "proposition bet" can be integrated into the embodiments in a variety of manners.

A "first-half bet" refers to a bet placed on the score in the first half of the event only and only considers the first half of the game or event. The process in which you go about placing this bet is the same process that you would use to place a full game bet, but as previously mentioned, only the first half is important to a first-half bet type of wager. A "half-time bet" refers to a bet placed on scoring in the second half of a game or event only. "First-half-bet" and "half-time-bet" can be integrated into the embodiments in a variety of manners.

A "futures bet" or "future" refers to the odds that are posted well in advance on the winner of major events, typical future bets are the Pro Football Championship, Collegiate Football Championship, the Pro Basketball Championship, the Collegiate Basketball Championship, and the Pro Baseball Championship. "Futures bet" or "future" can be integrated into the embodiments in a variety of manners.

The "listed pitchers" is specific to a baseball bet placed only if both of the pitchers scheduled to start a game actually start. If they don't, the bet is deemed "no action" and refunded. The "run line" in baseball, refers to a spread used instead of the money line. "Listed pitchers" and "no action" and "run line" can be integrated into the embodiments in a variety of manners.

The term "handle" refers to the total amount of bets taken. The term "hold" refers to the percentage the house wins. The term "juice" refers to the bookmaker's commission, most commonly the 11 to 10 bettors lay on straight point spread wagers: also known as "vigorish" or "vig". The "limit" refers to the maximum amount accepted by the house before the odds and/or point spread are changed. "Off the board" refers to a game in which no bets are being accepted. "Handle", "juice", vigorish", "vig" and "off the board" can be integrated into the embodiments in a variety of manners.

"Casinos" are a public room or building where gambling games are played. "Racino" is a building complex or grounds having a racetrack and gambling facilities for playing slot machines, blackjack, roulette, etc. "Casino" and "Racino" can be integrated into the embodiments in a variety of manners.

Customers are companies, organizations or individual that would deploy, for fees, and may be part of, of perform, various system elements or method steps in the embodiments.

Managed service user interface service is a service that can help customers (1) manage third parties, (2) develop the web, (3) do data analytics, (4) connect thru application program interfaces and (4) track and report on player behaviors. A managed service user interface can be integrated into the embodiments in a variety of manners.

Managed service risk management services are a service that assists customers with (1) very important person management, (2) business intelligence, and (3) reporting. These managed service risk management services can be integrated into the embodiments in a variety of manners.

Managed service compliance service is a service that helps customers manage (1) integrity monitoring, (2) play safety, (3) responsible gambling and (4) customer service assistance. These managed service compliance services can be integrated into the embodiments in a variety of manners.

Managed service pricing and trading service is a service that helps customers with (1) official data feeds, (2) data visualization and (3) land based, on property digital signage. These managed service pricing and trading services can be integrated into the embodiments in a variety of manners.

Managed service and technology platform are services that helps customers with (1) web hosting, (2) IT support and (3) player account platform support. These managed service and technology platform services can be integrated into the embodiments in a variety of manners.

Managed service and marketing support services are services that help customers (1) acquire and retain clients and users, (2) provide for bonusing options and (3) develop press release content generation. These managed service and marketing support services can be integrated into the embodiments in a variety of manners.

Payment processing services are those services that help customers that allow for (1) account auditing and (2) withdrawal processing to meet standards for speed and accuracy. Further, these services can provide for integration of global and local payment methods. These payment processing services can be integrated into the embodiments in a variety of manners.

Engaging promotions allow customers to treat your players to free bets, odds boosts, enhanced access and flexible cashback to boost lifetime value. Engaging promotions can be integrated into the embodiments in a variety of manners.

"Cash out" or "pay out" or "payout" allow customers to make available, on singles bets or accumulated bets with a partial cash out where each operator can control payouts by managing commission and availability at all times. The "cash out" or "pay out" or "payout" can be integrated into the embodiments in a variety of manners, including both monetary and non-monetary payouts, such as points, prizes, promotional or discount codes, and the like.

"Customized betting" allow customers to have tailored personalized betting experiences with sophisticated tracking and analysis of players' behavior. "Customized betting" can be integrated into the embodiments in a variety of manners.

Kiosks are devices that offer interactions with customers clients and users with a wide range of modular solutions for both retail and online sports gaming. Kiosks can be integrated into the embodiments in a variety of manners.

Business Applications are an integrated suite of tools for customers to manage the everyday activities that drive sales, profit, and growth, from creating and delivering actionable insights on performance to help customers to manage the sports gaming. Business Applications can be integrated into the embodiments in a variety of manners.

State based integration allows for a given sports gambling game to be modified by states in the United States or countries, based upon the state the player is in, based upon mobile phone or other geolocation identification means. State based integration can be integrated into the embodiments in a variety of manners.

Game Configurator allow for configuration of customer operators to have the opportunity to apply various chosen or newly created business rules on the game as well as to parametrize risk management. Game configurator can be integrated into the embodiments in a variety of manners.

"Fantasy sports connector" are software connectors between method steps or system elements in the embodiments that can integrate fantasy sports. Fantasy sports allow a competition in which participants select imaginary teams from among the players in a league and score points according to the actual performance of their players. For example, if a player in a fantasy sports is playing at a given real time sports, odds could be changed in the real time sports for that player.

Software as a service (or SaaS) is a method of software delivery and licensing in which software is accessed online via a subscription, rather than bought and installed on individual computers. Software as a service can be integrated into the embodiments in a variety of manners.

Synchronization of screens means synchronizing bets and results between devices, such as TV and mobile, PC and wearables. Synchronization of screens can be integrated into the embodiments in a variety of manners.

Automatic content recognition (ACR) is an identification technology to recognize content played on a media device or present in a media file. Devices containing ACR support enable users to quickly obtain additional information about the content they see without any user-based input or search efforts. To start the recognition, a short media clip (audio, video, or both) is selected. This clip could be selected from within a media file or recorded by a device. Through algorithms such as fingerprinting, information from the actual perceptual content is taken and compared to a database of reference fingerprints, each reference fingerprint corresponding to a known recorded work. A database may contain metadata about the work and associated information, including complementary media. If the fingerprint of the media clip is matched, the identification software returns the corresponding metadata to the client application. For example, during an in-play sports game a "fumble" could be recognized and at the time stamp of the event, metadata such as "fumble" could be displayed. Automatic content recognition (ACR) can be integrated into the embodiments in a variety of manners.

Joining social media means connecting an in-play sports game bet or result to a social media connection, such as a FACEBOOK® chat interaction. Joining social media can be integrated into the embodiments in a variety of manners. Augmented reality means a technology that superimposes a computer-generated image on a user's view of the real world, thus providing a composite view. In an example of this invention, a real time view of the game can be seen and a "bet" which is a computer-generated data point is placed above the player that is bet on. Augmented reality can be integrated into the embodiments in a variety of manners.

Some embodiments of this disclosure, illustrating all its features, will now be discussed in detail. It can be understood that the embodiments are intended to be open ended in that an item or items used in the embodiments is not meant to be an exhaustive listing of such item or items, or meant to be limited to only the listed item or items.

It can be noted that as used herein and in the appended claims, the singular forms "a," "an," and "the" include plural references unless the context clearly dictates otherwise. Although any systems and methods similar or equivalent to those described herein can be used in the practice or testing of embodiments, only some exemplary systems and methods are now described.

This is a system for a community-based event driven wagering platform. This System includes a live event 102, for example a sporting event such as a football game, basketball game, baseball game, hockey game, tennis match, golf tournament, eSports or digital game, etc. The live event will include some number of actions or plays, upon which a user or bettor or customer can place a bet or wager, typically through an entity called a sportsbook. There are numerous types of wagers the bettor can make, including, but not limited to, a straight bet, a money line bet, a bet with a point spread or line that bettor's team would need to cover, if the result of the game with the same as the point spread the user would not cover the spread, but instead the tie is called a push. If the user is betting on the favorite, they are giving points to the opposing side, which is the underdog or longshot. Betting on all favorites is referred to as chalk, this is typically applied to round robin, or other styles of tournaments. There are other types of wagers, including parlays, teasers and prop bets, that are added games, that often allow the user to customize their betting, by changing the odds and payouts they receive on a wager. Certain sportsbooks will allow the bettor to buy points, to move the point spread off of the opening line, this will increase the price of the bet, sometimes by increasing the juice, vig, or hold that the sportsbook takes. Another type of wager the bettor can make is an over/under, in which the user bets over or under a total for the live event, such as the score of American football or the run line in baseball, or a series of action in the live event. Sportsbooks have an amount of bets they can handle, a limit of wagers they can take on either side of a bet before they will move the line or odds off of the opening line. Additionally, there are circumstances, such as an injury to an important player such as a listed pitcher, in which a sportsbook, casino or racino will take an available wager off the board. As the line moves there becomes an opportunity for a bettor to bet on both sides at different point spreads in order to middle and win both bets. Sportsbooks will often offer bets on portions of games, such as first half bets and half time bets. Additionally, the sportsbook can offer futures bets on live events in the future. Sportsbooks need to offer payment processing services in order to cash out customers. This can be done at kiosks at the live event or at another location.

The system may include a plurality of sensors 104 that may be used such as motion sensors, temperature sensors, humidity sensors, cameras such as an RGB-D camera which is a digital camera providing color (RGB) and depth information for every pixel in an image, microphones, radiofrequency receiver, a thermal imager, a radar device, a lidar device, an ultrasound device, a speaker, wearable devices etc. Also, the plurality of sensors may include tracking devices, such as RFID tags, GPS chips or other such devices embedded on uniforms, in equipment, in the field of play, in the boundaries of the field of play, or other markers on the field of play. Imaging devices may also be used as tracking devices such as player tracking that provides statistical information through real-time X, Y positioning of players and X, Y, Z positioning of the ball. The system also includes a cloud 106 or communication network may be a wired and/or a wireless network. The communication network, if wireless, may be implemented using communication techniques such as Visible Light Communication (VLC), Worldwide Interoperability for Microwave Access (WiMAX), Long Term Evolution (LTE), Wireless Local Area Network (WLAN), Infrared (IR) communication, Public Switched Telephone Network (PSTN), Radio waves, and other communication techniques known in the art. The communication network may allow ubiquitous access to shared pools of configurable system resources and higher-level services that can be rapidly provisioned with minimal management effort, often over Internet and relies on sharing of resources to achieve coherence and economies of scale, like a public utility, while third-party clouds enable organizations to focus on their core businesses instead of expending resources on computer infrastructure and maintenance. The cloud may be communicatively coupled to server 108 which may perform real time analysis on the type of play and the result of the play. The cloud may also be synchronized with game situational data, such as the time of the game, the score, location on the field, weather conditions, and the like which may affect the choice of play utilized. For example, in other exemplary embodiments, the cloud may not receive data gathered from sensors and may, instead, receive data from an alternative data feed, such as SportsRadar. This data may be provided substantially immediately following the completion of any play and the data from this feed may be compared with a variety of team data and league data based on a variety of elements, including down, possession, score, time, team, and so forth, as described in various exemplary embodiments herein.

The system may include a server 108 which may perform real time analysis on the type of play and the result of a play or action. The server 108 (or cloud 106) may also be synchronized with game situational data, such as the time of the game, the score, location on the field, weather conditions, and the like which may affect the choice of play utilized. For example, in other exemplary embodiments, server 108 may not receive data gathered from sensors and may, instead, receive data from an alternative data feed, such as SportsRadar. This data may be provided substantially immediately following the completion of any play and the data from this feed may be compared with a variety of team data and league data based on a variety of elements, including down, possession, score, time, team, and so forth, as described in various exemplary embodiments herein. The server 108 can offer a number of software as a service managed services such as, user interface service, risk management service, compliance, pricing and trading service, IT support of the technology platform, business applications, game configuration, state based integration, fantasy sports connection, integration to allow the joining of social media, as well as marketing support services that can provide engaging promotions to the user. The user database 110 contains all the relevant information for every user of the system That data includes, their user identification, their location data, their wagering history, any communities they are a member of, communities they've been invited to join, peer to peer wagers they have proposed or have had proposed to them by other users, peer to peer messages, such as taunting, and the users they came from or are to be delivered to, as well as any specialty communities the user is a member of, such as celebrities. The base wagering module 112 allows the user to log in and place wagers on individual plays or events in a sporting event. In additional to processing wagers, the base wagering module calls when appropriate the community building module, to allow the user to join communities of users, a leaderboard module, to allow the user to see how they rank against other groups of users, and the peer to peer module, to allow the user to send messages, such as taunts, to other users, as well as proposed wagers directly with other users. The community building module 114 allows the user to join communities and invite others to join communities they are already a member of. The leaderboard module 116 allows the user to see how they rank against other users in a community they are a member of, or a specialty community, such as professional athletes. The peer to peer module 118 allows the user to message other users and propose wagers directly to other users. a user device such as a computing device, laptop, smartphone, tablet, computer, smart speaker, or I/O devices. I/O devices may be present in the computing device. Input devices may include keyboards, mice, trackpads, trackballs, touchpads, touch mice, multi-touch touchpads and touch mice, microphones, multi-array microphones, drawing tablets, cameras, single-lens reflex camera (SLR), digital SLR (DSLR), CMOS sensors, accelerometers, infrared optical sensors, pressure sensors, magnetometer sensors, angular rate sensors, depth sensors, proximity sensors, ambient light sensors, gyroscopic sensors, or other sensors. Output devices may include video displays, graphical displays, speakers, headphones, inkjet printers, laser printers, and 3D printers. Devices may include a combination of multiple input or output devices, including, e.g., Microsoft KINECT, Nintendo Wiimote for the WIT, Nintendo WII U GAMEPAD, or Apple IPHONE. Some devices allow gesture recognition inputs through combining some of the inputs and outputs. Some devices provide for facial recognition which may be utilized as an input for different purposes including authentication and other commands. Some devices provides for voice recognition and inputs, including, e.g., Microsoft KINECT, SIRI for IPHONE by Apple, Google Now or Google Voice Search.

Additional devices have both input and output capabilities, including, e.g., haptic feedback devices, touchscreen displays, or multi-touch displays. Touchscreen, multi-touch displays, touchpads, touch mice, or other touch sensing devices may use different technologies to sense touch, including, e.g., capacitive, surface capacitive, projected capacitive touch (PCT), in-cell capacitive, resistive, infrared, waveguide, dispersive signal touch (DST), in-cell optical, surface acoustic wave (SAW), bending wave touch (BWT), or force-based sensing technologies. Some multi-touch devices may allow two or more contact points with the surface, allowing advanced functionality including, e.g., pinch, spread, rotate, scroll, or other gestures. Some touchscreen devices, including, e.g., Microsoft PIXELSENSE or Multi-Touch Collaboration Wall, may have larger surfaces, such as on a table-top or on a wall, and may also interact with other electronic devices. Some I/O devices, display devices or group of devices may be augmented reality devices. The I/O devices may be controlled by an I/O controller. The I/O controller may control one or more I/O devices, such as, e.g., a keyboard and a pointing device, e.g., a mouse or optical pen. Furthermore, an I/O device may also provide storage and/or an installation medium for the computing device. In still other embodiments, the computing device may provide USB connections (not shown) to receive handheld USB storage devices. In further embodiments, an I/O device may be a bridge between the system bus and an external communication bus, e.g. a USB bus, a SCSI bus, a FireWire bus, an Ethernet bus, a Gigabit Ethernet bus, a Fiber Channel bus, or a Thunderbolt bus. The user device 120 can leverage the sensors in for purposes such as automatic content recognition, augmented reality or the synchronization of screens between the user device interface and other displays. The interface(s) 122 may either accept inputs from users or provide outputs to the users, or may perform both the actions. In one case, a user can interact with the interface(s) 122 using one or more user-interactive objects and devices. The user-interactive objects and devices may include user input buttons, switches, knobs, levers, keys, trackballs, touchpads, cameras, microphones, motion sensors, heat sensors, inertial sensors, touch sensors, or a combination of the above. Further, the interface(s) 122 may either be implemented as a Command Line Interface (CLI), a Graphical User Interface (GUI), a voice interface, or a web-based user-interface.

Functioning of the user database will now be explained with reference to FIG. 2. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

This figure displays the user database. The database contains all information about each user of the system. The first column contains their user identification. The second column contains their current location and location history. The third column contains their wagering history. The fourth column is for the communities the user is a member of, which each community 1-*n* having its own sub section. The fifth column records the peer to peer wagers the user has currently proposed or has had proposed to them, along the other user involved in the peer to peer wager, and the odds associated with the wager, each peer to peer wage having its own sub section. The sixth column contains peer to peer messages, such as taunting, along with the user who the message is from or being delivered to, each peer to peer message having its own sub section. The seventh column contains all communities that the user has been invited to join, either by the system for reasons such as the user's current location, or by a member of the community, each invitation having its own sub section. The final column contains an specialty community, such as celebrities, professional athletes and gamblers, or based on specific professions or other attributes of interest, each specialty community having its own sub section in element 200.

Figure 3:
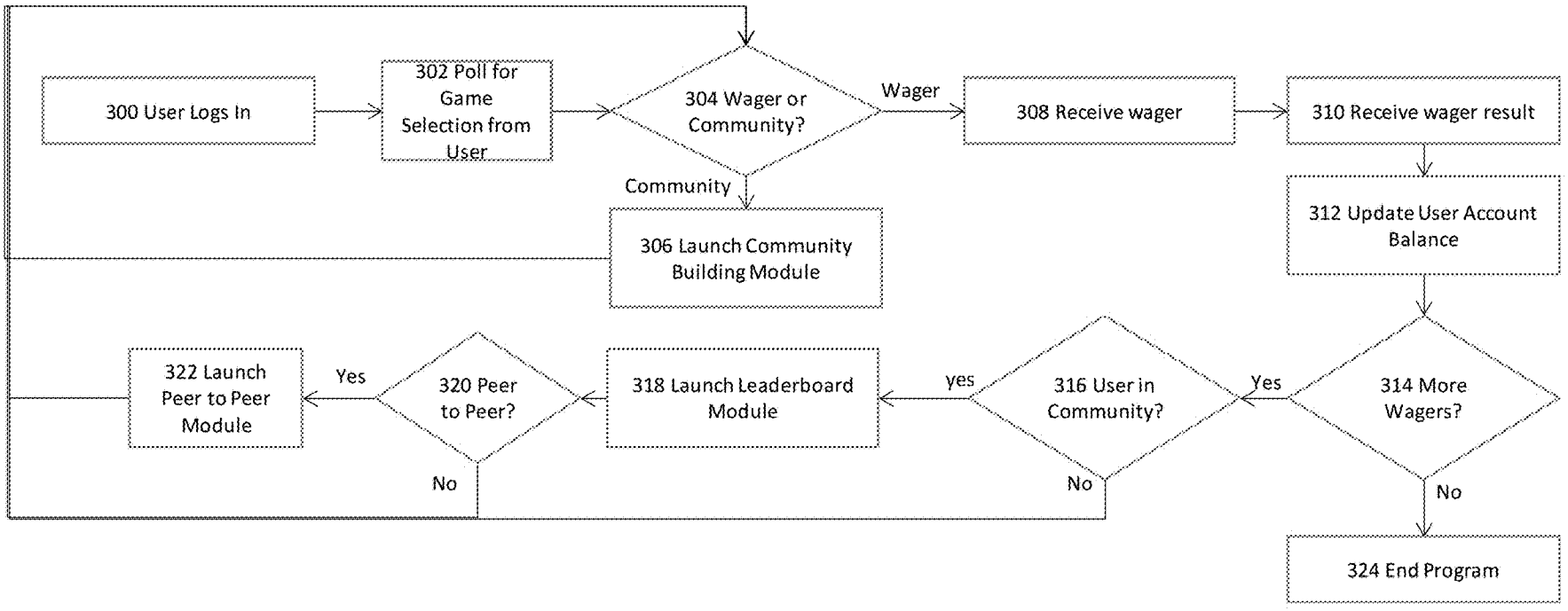
FIG. 3 illustrates a base wagering module, according to an embodiment.

Functioning of the base wagering module will now be explained with reference to FIG. 3. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

This figure displays the "base wagering module. The process begins with the user logging into the play by play wagering system hosted on the server. Play data can be any sensor data that indicates anything about the live game, such as, but no limited to audio of visual data that indicates "actions", "sides", "event" data, "total" data, "listed pitchers", specific players, whistles, fouls, touchdowns, goals, yardage, player error, etc., at step 300. The user is presented with games available to wager on through the user device interface and the module polls for the user's selection of the game they want to wager on, at step 302. The base wagering module then receives the selection from the user of the game they wish to bet upon, or their desire to join a new community, at step 304. If the user selects to join a community, the community building module is launched, at step 306. If the user selects to make a wager, the wagers available for the selected game are presented to the user. This includes wagers that have been proposed to the user through the peer to peer module. The user's selection of which wager they want to take, and the parameters, such as odds and wager amount, are received by the base wagering module. Wager data can be a "Bet" or "wager" or "buy points" or "price" or "no action" or "favorite" or "chalk" or "circled game" or "laying the points price" or "dog" or "underdog" or "money line" or "straight bet" or "straight-up" or Line" or "cover the spread" or "cover" or "tie" or "pick" or "pick-em" or "middle" or "parlay" or "round robin" or "teaser" or "prop bet" or "first-half-bet" or "half-time-bet" or "futures bet" or "future" or "handle" or "juice" or "vigorish" or "off the board", at step 308. The base wagering module then receives the wager result, at step 310. The wager result can come from a variety of sources including, but not limited to, a third-party statistics provider, sensor data on the field/players, image recognition systems, etc. The wager result could also be based on the user's position on a community leaderboard, in which that community has terms in which the top ranked player receives the largest payout, and the payouts decrease as the rankings descend and only a portion of the community members receive a payout. The base wagering module receives the wager result, at step 312. Determine if the user wishes to place more wagers, at step 314. If the user wishes to make more wagers, determine if the user is at least one community, at step 316. If the user is in at least one community, or has at least one community invited in their user database record, launch the leaderboard module, at step 318. When the leaderboard module is complete, poll the user for any desired peer to peer interactions, at step 320. If the user elects to, launch the peer to peer module, at step 322. After the peer to peer module is complete the module goes back to step 304. When the user elects no more wagers at step 314, the program ends. It should be noted that the base wagering module can be made available for access, reconfiguration, modification, or control for "customers" or used for "Managed service user interface service", "Managed service risk management services", "Managed service compliance service", "Managed service pricing and trading service", "Managed service and technology platform", "Managed service and marketing support services", "Payment processing services", "Engaging promotions", "Customized betting", "Business Applications", "State based integration", "Game Configurator", "Fantasy sports connector", "Software as a service", "Synchronization of screens", "Automatic content recognition (ACR)", "Joining social media", and "Augmented reality", at step 324.

Figure 4:
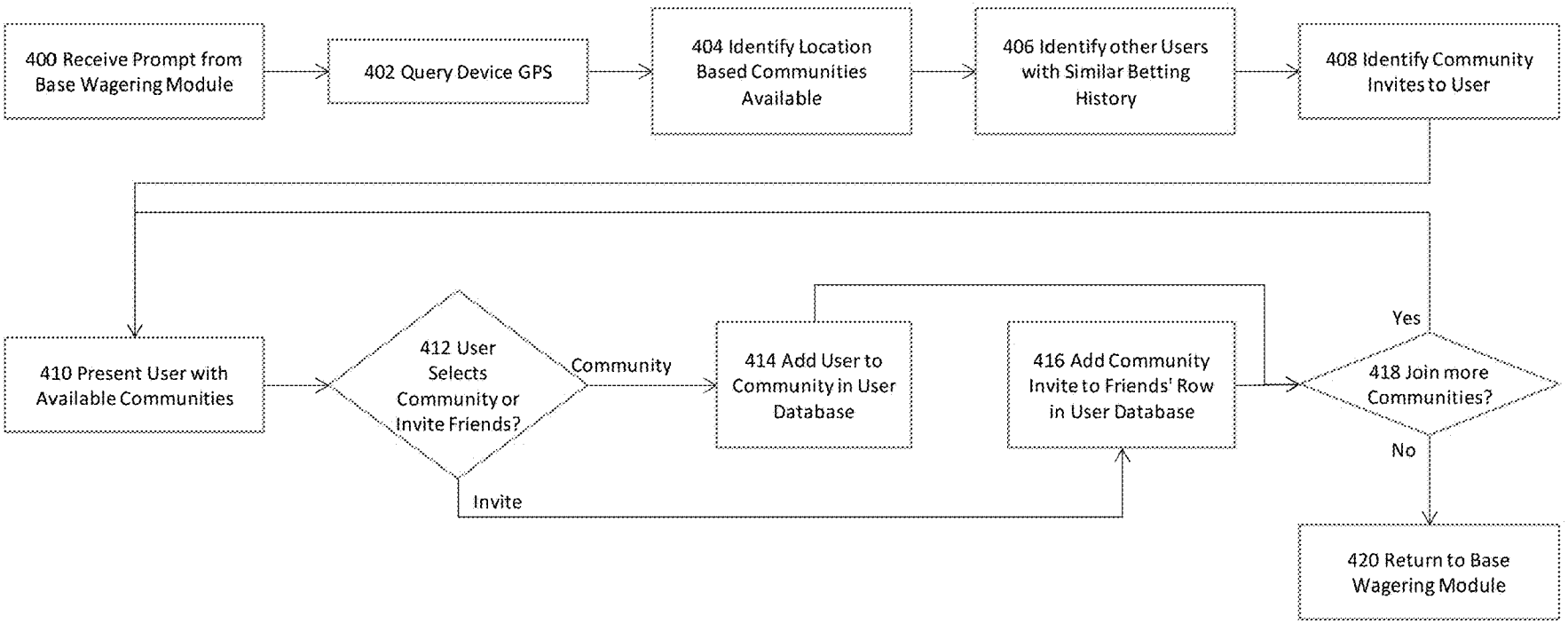
FIG. 4 illustrates a community building module, according to an embodiment.

Functioning of the community building module will now be explained with reference to FIG. 4. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

This figure displays the community building module. The process begins with receiving a prompt from the base wagering module, at step 400. The community building module then queries the GPS of the user device to determine the user's physical location, at step 402. The community building module allows for the identification all of the potential location based communities the user could join based on their current location, at step 404. The community building module allows for the identification of other users with similar betting history. For instance, potential location based communities could be based on the broadcast area of a given team, so as to capture all the fans of that team. It could also be more localized to a particular town, or the stadium in which the game is being played, or any other type of area that makes sense for dividing viewers of a given game. The user database is then queried to identify users with a similar betting history to the user, at step 406. The community building module allows for the identification of community invites. For example, similar betting history could be defined as, a plurality of wagers on a similar team, a similar winning percentage, a similar betting style, similar wager amounts, etc. The user database is then queried for any invites sent to the user from other community members at step 408. The community building module present the user with all of the communities identified in steps 404, 406 and 408, and display those communities for the user to select on the user device interface, at step 410. The community building module allows the user to be presented with the option to invite another user to join a community of which they are a part. The system then receives the selection of available community or send a friend an invitation, at step 412. The community building module allows the user to select a community to join, that community is added to the user's record in the user database, at step 414. The community building module allows the user to send a community invite to another user, the details of that invitation are written to the target user's record in the user database, at step 416. The community building module then polls the user for additional communities to join or friends to invite, at step 418. The community building module allows for the user to join another community or invite another friend to a community the module returns to step 410. If the user does not want to join another community or invite another friend, the module returns to the base wagering module, at step 420.

Figure 5:
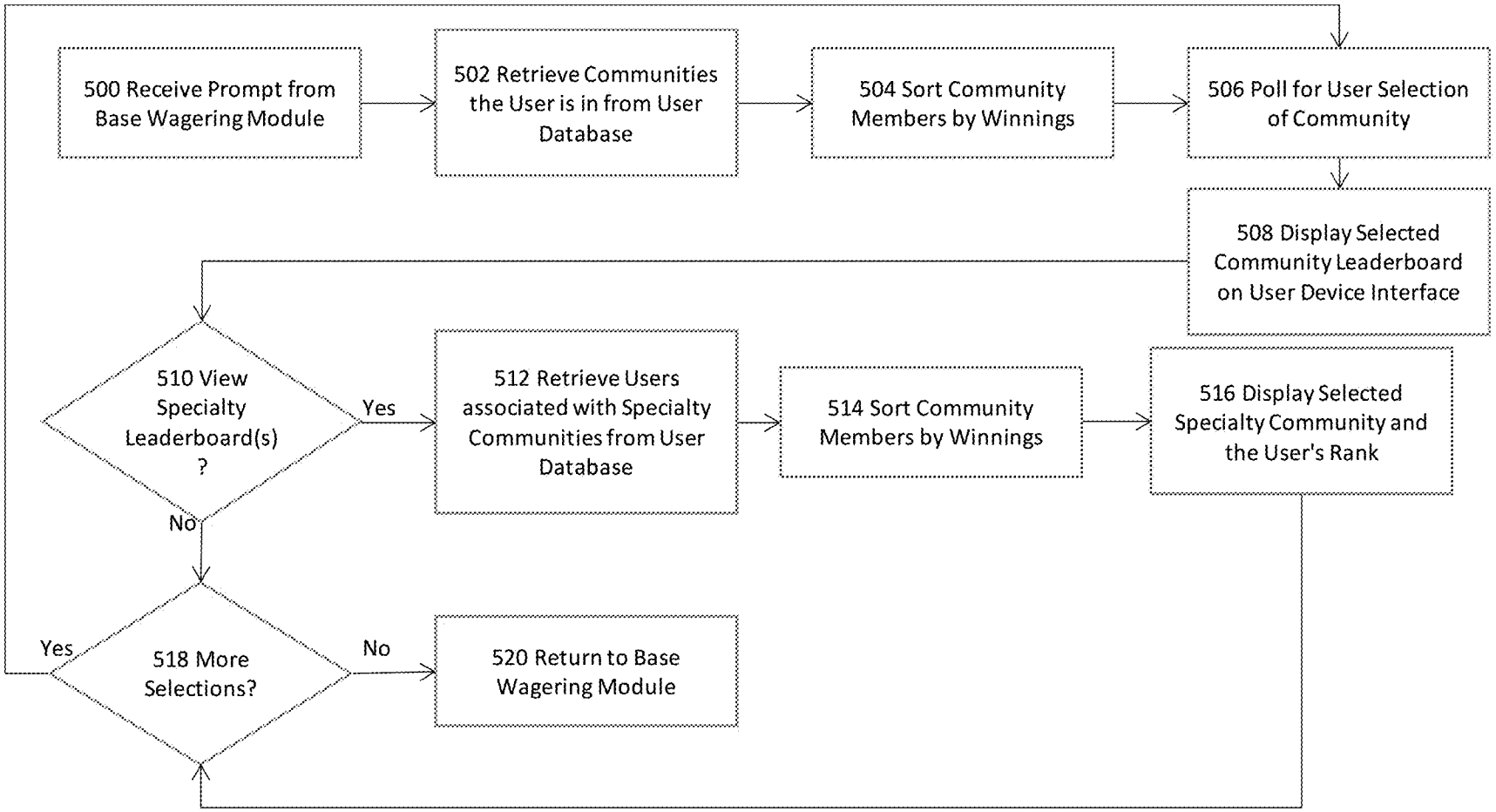
FIG. 5 illustrates a leaderboard module, according to an embodiment.

Functioning of the leaderboard module will now be explained with reference to FIG. 5. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

This figure displays the leaderboard module. The process begins with the leaderboard module receives a prompt from the base wagering module, at step 500. The leaderboard module then retrieves, from the user database, all communities the user is a member of, at step 502. The leaderboard module allows for members of the identified communities are then sorted by their winnings, at step 504. The leaderboard module then polls for the user's selection of which community they are a member of that they wish to view their standing on the leaderboard, at step 506. The leaderboard module allows for each community is sorted individually. Winnings can mean total money or points won in a given time period, such as during the current game or series of games, or winning percentage, or some other method of ranking the users based upon their wagering history. The module then displays the selected community on the user device interface sorted by rank with the user's standing on the leaderboard highlighted, at step 508.

The leaderboard module then determines if the user wants to view a specialty leaderboard, at step 510. The leaderboard module allows for specialty leaderboards which are those that are not communities the user is a member of, but collections of people with a similar characteristic, such as celebrities, professional athletes, etc. If the user does not elect to view a specialty leaderboard, the module proceeds to step 518. If the user selects one of the specialty leaderboards available, the modules retrieves from the user database all users associated with the selected leaderboard, at step 512. The leaderboard module allows for the retrieved community of specialty users to be sorted by winnings, at step 514. The leaderboard module allows for the selection of a specialty community leaderboard which is then displayed on the user device interface along with the user's relative rank amongst the community, at step 516. The leaderboard module allows for the determination if the user has more communities to select, at step 518. The leaderboard module allows for the user to select another community, the module returns to step 506. If the user does not want to select another community leaderboard, the module returns to the base wagering module, at step 520.

Figure 6:
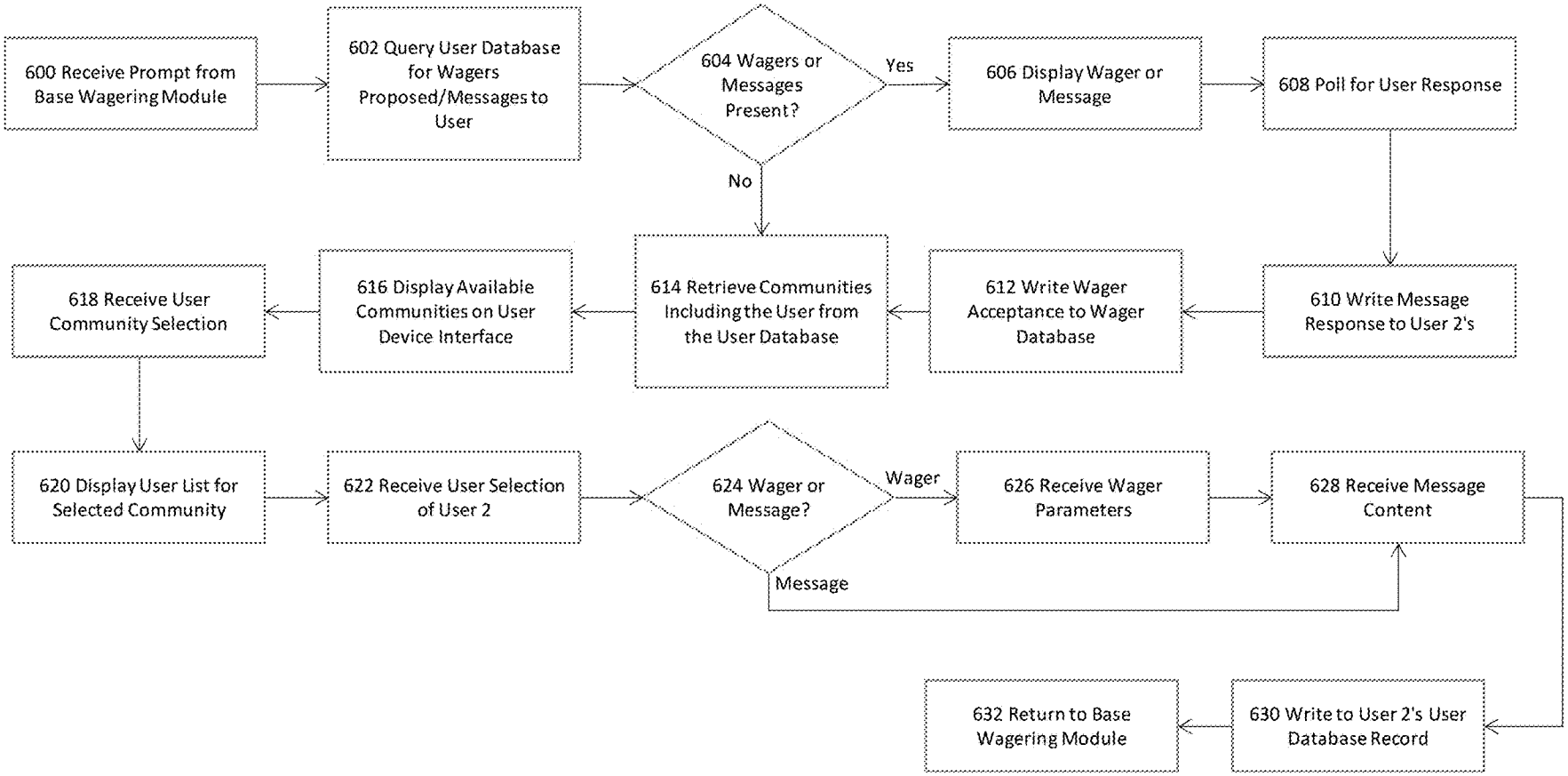
FIG. 6 illustrates a peer to peer module, according to an embodiment.

Functioning of the peer to peer module will now be explained with reference to FIG. 6. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

This figure displays the peer to peer module. The process begins with The peer to peer module allows for receiving a prompt from the base wagering module, at step 600. The peer to peer module then polls the user database for any wagers proposed, or messages sent to the user by another user that shares at least one community with, at step 602. The peer to peer module then determines if there are any wagers or messages present, at step 604. The peer to peer module then displays the wager proposed or message to user, at step 606. The peer to peer module then polls for the user's response to the message or wager, at step 608. The peer to peer module allows for the determination of the user response to a message, the user's response is written to user 2's (the user with whom the original user is communicating) record in the user database, at step 610. The peer to peer module allows for the determination of the users response to a proposed wager, the user's acceptance or rejection of the wager is recorded in user 2's record in the user database, at step 612. The peer to peer module then retrieves all of the communities the user belongs to from the user database, at step 614. The peer to peer module displays available communities on the user device interface and poll for a user selection, at step 616. The peer to peer module receive the community selected by the user, at step 618. The peer to peer module display the users in the selected community on the user device interface, at step 620. The peer to peer module receives the user selection of which user, referred to as user 2, they wish to send a message to or propose a wager to, at step 622. The peer to peer module polls for and receives the user selection of a wager to propose to user 2 or a message to send to user 2, at step 624. The peer to peer module allows for the user to elect to propose a wager to user 2, the user enters the parameters, such as odds, amount and context, of the wager, at step 626. The peer to peer module allows for the user to elect to send a message to user 2, such as taunting user 2 for a wager or game result, the message content is collected from the user, at step 628. The peer to peer module allows for the content of the user message or the wager proposed is then recorded in the user database in user 2's record, at step 630. The peer to peer module then returns to the base wagering module, at step 632.

What is claimed is:

1. A method for building a gaming community, comprising:

providing a plurality of communities in a real time wagering platform, wherein the plurality of communities are configured as organizational groupings within the real time wagering platform for organizing a plurality of users of the real time wagering platform, and wherein one or more of the plurality of communities are based on at least a geographical location and one or more of the plurality of communities are based on at least a prescribed betting style;

storing, in a user database, information regarding each of the plurality of users, wherein the information regarding each of the plurality of users comprises: received invitations to join one or more of the plurality of communities, membership with one or more of the plurality of communities, and a betting history;

calculating odds of events within a live sporting event for real time play by play wagering;

communicating the odds as available wagers to a mobile device of at least one of the plurality of users;

receiving selected wagers from the mobile device of at least one of the plurality of users;

receiving, by the wagering platform, a GPS location from the mobile device of at least one of the plurality of users;

identifying, by the real time wagering platform and based on the GPS location received, eligibility of one or more of the plurality of users to join the one or more of the plurality of communities having geographical location;

identifying, by the real time wagering platform and based on the betting history stored in the user database, eligibility of one or more of the plurality of users to join the one or more of the plurality of communities having the prescribed betting style;

receiving, by the real time wagering platform, sensor data captured from sensors monitoring the live sporting event, utilizing, by the real time wagering platform, at least the sensor data captured from sensors monitoring the live sporting event to determine a wager result of the live sporting event;

determining that two or more of the plurality of users are members of a same community among the plurality of communities in the real time wagering platform; and facilitating communication between the two or more of the plurality of users of the same community of the real time wagering platform, wherein each of the plurality of communities comprises a leaderboard, and wherein, the mobile device of a user:

prompts the user with the plurality of selectable communities identified by the real time platform and which the user is eligible to join, wherein the prompt is in a format which is selectable by the user to join or to share with another user; and displays the leaderboard selected from those of the plurality of communities of which the user is currently a member and selected leaderboards which the user is not a member of.

2. The method of claim 1, wherein the prescribed betting style is based on an average betting amount of a group of users.

3. The method of claim 1, wherein the prescribed betting style is based on a betting history of a group of users.

4. The method of claim 1, further comprising providing peer to peer wagering between two or more users of the same community.

5. The method of claim 1, wherein a winnings payout for a wager associated with one of the plurality of communities is proportioned based upon the user's ranking on the leaderboard of the one of the plurality of communities.

6. The method of claim 1, wherein one or more of the plurality of communities are based on a sports team.

7. A system for executing a community-based game, comprising:

at least one processor and at least one memory having instructions stored thereon which, when executed by the at least one processor, direct the at least one processor to:

provide a plurality of communities, the plurality of communities configured as organizational groupings for organizing a plurality of users;

a user database which stores information regarding each of the plurality of users, wherein the information regarding each of the plurality of users comprises: received invitations to join one or more of the plurality of communities, membership with one or more of the plurality of communities, and a betting history;

sensors monitoring the live sporting event which transmit sensor data captured by the sensors to the at least one processor, wherein the at least one processor parses at least the sensor data captured by the sensors to determine a wager result of the live sporting event; and a plurality of mobile devices, each of which are associated with at least one of the plurality of users, wherein one or more of the plurality of communities are based on at least a geographical location and one or more of the plurality of communities are based on at least a prescribed betting style, wherein the at least one processor calculates odds of events within the live sporting event for real time, play by play wagering and communicates the odds as available wagers to the plurality of mobile devices, wherein the plurality of mobile devices are each configured to transmit selected wagers to the at least one processor, geolocate the mobile device using GPS, and display leaderboards to a user, wherein the at least one processor is further configured to receive a GPS location of each of the plurality of mobile devices and to determine, based on the GPS location received, eligibility of the one or more users associated with the mobile device to join the one or more of the plurality of communities having geographical locations, wherein the at least one processor is further configured to determine, based on the betting history stored in the user database for each of the plurality of users, eligibility of each of the plurality of users to join one or more of the plurality of communities having the prescribed betting style, wherein each of the plurality of communities comprises a leaderboard, and wherein, the user's mobile device is further configured to:

prompt the user with those of the plurality of communities identified by the at least one processor and which the user is eligible to join in a format which is selectable by the user to join or to share with another user; and display the leaderboard selected from those of the plurality of communities of which the user is currently a member of and selected communities which the user is not a member of.

8. The system of claim 7, wherein the leaderboard displays a ranked list of users within the corresponding community.

9. The system of claim 7, wherein the leaderboard displays a ranked list of users based on a characteristic associated with the users.

10. The system of claim 7, wherein invitations to join one or more of the plurality of communities are exchangeable between the plurality of users.

11. The system of claim 7, wherein wagers are exchanged between the plurality of users through peer to peer communication.

12. The system of claim 7, wherein the leaderboard facilitates ranking users in a community among the plurality of communities.

* * * * *